United States Patent [19]

von Ondarza

[11] Patent Number: 4,706,315

[45] Date of Patent: Nov. 17, 1987

[54] PROCESS FOR THE TREATMENT OF KNITWARE

[75] Inventor: Leon von Ondarza, Aachen, Fed. Rep. of Germany

[73] Assignee: H. Krantz GmbH & Co., Aachen, Fed. Rep. of Germany

[21] Appl. No.: 854,986

[22] Filed: Apr. 22, 1986

[30] Foreign Application Priority Data

Apr. 24, 1985 [DE] Fed. Rep. of Germany ..... 3514735

[51] Int. Cl.[4] ..... D06B 5/18; D06B 21/00

[52] U.S. Cl. ..... 8/155.1; 8/155

[58] Field of Search ..... 8/154, 155, 155.1, 155.2; 26/82

[56] References Cited

U.S. PATENT DOCUMENTS

| | | | |
|---|---|---|---|
| 997,292 | 7/1911 | Hebden et al. | 8/155.1 |
| 2,196,270 | 4/1940 | Moncrieff et al. | 8/155 X |
| 4,097,232 | 6/1978 | Negola et al. | 8/154 X |

FOREIGN PATENT DOCUMENTS

| | | | |
|---|---|---|---|
| 1192274 | 5/1970 | United Kingdom | 26/82 |

*Primary Examiner*—Philip R. Coe

*Attorney, Agent, or Firm*—W. G. Fasse; D. H. Kane, Jr.

[57] ABSTRACT

Knitware in hose form is prepared for a wet treatment, a preliminary dewatering, and for drying, by winding the hose into wound laps under a constant winding tension, so that the laps have a density of more than 200 and less than 400 g/dm$^3$. The lap is coaxially compressed to reduce its original axial length by 3% to 8% and in this state the lap is exposed to dye liquor, flowing, for example, alternately radially inwardly or radially outwardly or axially in alternate directions. The lap is then preliminarily dewatered in an unvaried state, preferably by rotation. Thereafter, the lap is subjected in the same state to a drying treatment. The drying treatment may, in the alternative, be performed after the knitware has been unrolled and the hose has been cut lengthwise for securing the knitware in its spread-out state to a tentering frame which is then passed through a drying chamber.

7 Claims, No Drawings

PROCESS FOR THE TREATMENT OF KNITWARE

FIELD OF THE INVENTION

This invention relates to a process for the wet treatment, preliminary dewatering, and drying of knitware.

DESCRIPTION OF THE PRIOR ART

For wet treatment, and particularly for dyeing, it is generally known to draw circularly-knitted ware as a strand into a dyeing vat at a speed of 30 to 80 m/min, to connect the ends of the strand together to form an endless strand which is then drawn through a dyeing liquor bath with the aid of a winder or winch or a ring nozzle charged with dyeing liquor, at speeds of between 100 and 300 m/min for 6 to 8 hours. After this treatment, the ends of the strand are separated again, whereupon the strand is drawn out of the dyeing apparatus, placed into a net and centrifuged for a preliminary dewatering. Then the ware hose or tube is cut lengthwise, spread out and calendered, whereupon it is conducted in a spread-wide state on a tentering frame through a drying chamber for the drying treatment and possibly also for a fixing treatment.

During the just described generally known treatment, the knitware undergoes various stresses, the effects of which cannot always be completely obviated even by using considerably expensive and complex technical aids.

The traction-sensitive knitware initially undergoes length and surface stressing while it is drawn into the dyeing vat. This stressing continues during the strand rotation throughout the entire duration of the wet treatment and leads to considerable surface roughening and, despite continuous strand displacement also to chafing and abrasion marks on the knitware. Knot formations causing interruptions in the ware rotation, also cause spots or strand portions having an unequal dyeing or appearance. These phenomena require extensive, time-consuming and thus costly remedial treatments, which do not necessarily ensure complete removal of all the damage caused to or on the knitware.

Since the fully treated knitware is to have residual shrinkage values of not more than 5%, the lengthening of the ware caused by the treatment has to be reversed by stretching the ware in the crosswise direction while the ware is advancing.

In summary, it is necessary to use complex mechanically trouble-prone devices and costly machinery, to bring the highly-strained knitware back into the state which it had prior to the wet treatment.

OBJECTS OF THE INVENTION

In view of the foregoing it is the aim of the invention to achieve the following objects singly or in combination:

to propose a process for the wet treatment of knitware in which during all the treatment steps the ware is not exposed to any stressing which impairs the quality of the ware in any way, so that complex quality-regenerating measures can be avoided;

to treat the ware primarily in a rolled-up or wound lap state; and to avoid the formation of an endless strand of the knitware.

SUMMARY OF THE INVENTION

According to the invention knitware in hose form is wound up under constant winding tension to form a wound lap with a density of more than 200 and less than 400 g/dm$^3$. The lap formed in this way is shortened by coaxial pressing by at least 3% and at the most 8% of its axial length and, with the knitware in this state, dyeing liquor is caused to flow through the wound lap and then the knitware is preliminarily dewatered and finally dried.

DETAILED DESCRIPTION OF PREFERRED EXAMPLE EMBODIMENTS AND OF THE BEST MODE OF THE INVENTION

The knitware discharged in hose, i.e. tubular form, from a circular knitting machine is already wound into a lap which saves space and facilitates the transportation of the ware. In this respect, for the successful performance of the present process it is merely necessary that the winding tension is kept constant and the required lap density is achieved. The resulting wound lap exhibits a homogeneous flow resistance to the treatment medium, whereby the evenness or uniformity of the flow resistance through the entire volume of the lap is additionally optimized by subjecting the lap to a limited coaxial compression.

Such a knitware lap behaves, with respect to a uniform wet treatment, like yarn laps treated in a similar way. It had previously been feared that transfer of the wet treatment processes known for yarn packages to knitware would cause the hose folds on both sides to form markings on the ware, since these hose folds are not subject to any displacement during the treatment and moreover, the flow conditions in the hose fold regions are different, for example, from those in the central hose region. Surprisingly, however, it has been shown that the lap density in accordance with the invention leads, when acted upon by dyeing liquor, to an even, if limited, inflation or swelling of the hose windings which, as it turns out, is fully sufficient to prevent sharp-edged folds during the period of liquor application. As a result of the ever so slight inflation of the hose windings, liquid channels are formed which extend as far as the package edges and ensure a marking-free homogeneous wet treatment.

For the preliminary dewatering which is necessary after the wet treatment, it is not necessary in accordance with the method of the invention, to form the hoseware or turbular fabric into a different shape or to subject it to other extensive manipulations. Instead, the wound lap is preliminarily dewatered in its unvaried form, for example, by rotation about its axis or else by a circular arrangement of a number of packages in a centrifuge drum, and finally dried.

In accordance with a preferred mode of the invention, the knitware is wound up with a density of 300 g/dm$_3$ and the wound lap is arranged vertically with its axis and compressed coaxially by 5% of its original height and is acted upon by dyeing liquor axially from the bottom upward or from the top downward or radially from the inside outward or from the outside inward.

Irrespective of the direction chosen for the liquor flow, the wound lap density adhered to in accordance with this method leads to a homogeneous wet treatment of the knitware. For practical reasons only, it appears to be particularly advantageous to apply liquor to the lap radially from the inside outward and, possibly alternately, radially from the outside inward. In this respect, a dyeing liquor circulation can be maintained in which the liquor path, beginning on the pressure side of a pump, leads by way of a radially perforated lap carrier substantially radially through the package, then by way of an annular space surrounding the package, to the suction side of the pump. The reversal of the liquor circulation direction can be effected in a known manner with the aid of a four-way valve, insofar as the pressure side and suction side of the pump are not directly interchangeable, for example by reversal of the direction of rotation.

A particularly expedient performance of the present process can be achieved, if a number of wound laps is arranged coaxially one above the other to form a lap column, whereupon the entire lap column is compressed or compacted and then exposed to the dyeing liquor.

It will be appreciated from the above description that the invention proposes application of the treatment which is known for yarn laps, to laps of hose-shaped or tubular knitware and this, surprisingly, leads to comparable results, although the differences in the material shape between yarn laps on the one hand and knitware laps on the other hand, necessitate completely different conditions and these would also have led one to expect different results.

Preferably, in accordance with a further embodiment of the process of the invention, the lap column is, after the wet treatment, preliminarily dewatered by rotation in a compressed or uncompressed, but in other respects, unvaried state.

Also for the performance of this process, either a lap column can be preliminarily dewatered by rotation about its axis or else a number of lap columns arranged in a circle can be rotated in a centrifuge drum for a preliminary dewatering. Particularly suitable for the simultaneous preliminary dewatering of a number of lap columns is a centrifuge drum having an inner holder provided with shells or recesses which are adapted to the radius of the lap columns and which extend over the height thereof, so that, upon rotation, the individual lap columns are supported against the centrifugal force, and in so doing maintain their shape substantially unvaried.

However, in accordance with a further, alternative, embodiment of the process of the invention, the lap columns, after the preliminary dewatering, may be separated into individual laps which are then subjected, in a state which is in other respects unvaried, to the drying. For this process step the individual laps may be caused to run in an orderly formation on a conveyor belt through a high-frequency dryer. However, it is also possible to run the laps through a high-frequency dryer while suspended in column form on consecutive spaced apart hooks of a suspension transportation mechanism.

Depending on the demands which are to be made on the fully treated or finish-treated knitware, the laps can be unrolled and the ware hoses cut lengthwise and interconnected to form a continuous ware web which is spread or stretched onto a tentering frame for further treatment such as drying in a drying chamber, fixing, and possibly providing a finish to the knitware.

As a result of the process according to the invention, knitware rolled up underneath a knitting machine into laps of, for example, 30 kg with a lap diameter of about 600 mm and a lap axial length between 200 and 800 mm can be wet-treated and preliminarily dewatered in a particularly careful manner in unvaried hose or tubular form. The maintenance of the lap of knitware in hose form, at least during the complete wet treatment and preliminary dewateing process, obviates the need for complex wet-treatment equipment, such as winch and nozzle dyeing machinery, and the expenditure of energy needed for operating such machinery is also saved. Further, the previous need for remedying defects in the tubular ware arising during conventional wet-treatment thereof, has also been eliminated.

Although the invention has been described with reference to specific example embodiments, it will be appreciated, that it is intended to cover all modifications and equivalents within the scope of the appended claims.

What I claim is:

1. A process for the wet treatment, preliminary dewatering and drying of knitware, comprising the following steps:

(a) winding said knitware as a hose under constant winding tension to form a wound lap having a first axial length and a density of more than 200 and less than 400 g/dm$^3$, (b) coaxially compressing said wound lap by at least 3% and at the most 8% of said first axial length for shortening said wound lap to a second axial length, (c) flowing a dye liquor through said wound lap in its shortened state, (d) preliminarily dewatering said wound lap, and (e) drying the dewatered wound lap.

2. The process of claim 1, further comprising selecting said winding tension for forming said wound lap with a density of 300 g/dm3, selecting said compressing so that said first axial length is reduced by 5%, arranging said wound lap with its longitudinal axis in a substantially vertical orientation, and flowing said dye liquor through said wound lap in an axial or radial direction.

3. The process of claim 1, comprising assembling a number of wound laps coaxially one above the other to form a lap column, axially compressing said lap column, and then exposing said lap column to said dye liquor.

4. The process of claim 3, preliminarily drying said lap column after said exposing, by rotating said lap column.

5. The process of claim 4, comprising first releasing said compressing prior to said rotating for said dewatering.

6. The process of claim 4, comprising separating said lap column, after said rotating, into said wound laps, and then drying said wound laps.

7. The process of claim 1, further comprising cutting said hose of knitware, after the preliminary dewatering, stretching said cut knitware onto a tentering frame, and passing said tentering frame through a drying station.

* * * * *